US009157277B2

(12) United States Patent
Krueger, V et al.

(10) Patent No.: US 9,157,277 B2
(45) Date of Patent: Oct. 13, 2015

(54) MOTOR SAVER SUB FOR DOWN HOLE DRILLING ASSEMBLIES

(71) Applicant: WWT International, Inc., Houston, TX (US)

(72) Inventors: Rudolph Ernst Krueger, V, Aliso Viejo, CA (US); Eric O'Neal, Mission Viejo, CA (US)

(73) Assignee: WWT North America Holdings, Inc., Houston, TX (US)

( * ) Notice: Subject to any disclaimer, the term of this patent is extended or adjusted under 35 U.S.C. 154(b) by 366 days.

(21) Appl. No.: 13/759,989

(22) Filed: Feb. 5, 2013

(65) Prior Publication Data

US 2013/0199846 A1 Aug. 8, 2013

Related U.S. Application Data

(60) Provisional application No. 61/595,561, filed on Feb. 6, 2012.

(51) Int. Cl.
*E21B 44/06* (2006.01)
*E21B 4/02* (2006.01)
*E21B 44/00* (2006.01)

(52) U.S. Cl.
CPC ..... *E21B 4/02* (2013.01); *E21B 44/005* (2013.01)

(58) Field of Classification Search
CPC ..... E21B 4/02; E21B 4/18; E21B 7/00
USPC ..... 175/25, 26, 107, 317
See application file for complete search history.

(56) References Cited

U.S. PATENT DOCUMENTS

| | | | | |
|---|---|---|---|---|
| 4,768,598 | A | 9/1988 | Reinhardt | |
| 5,101,907 | A | 4/1992 | Schultz et al. | |
| 5,355,960 | A | 10/1994 | Schultz et al. | |
| 6,073,708 | A * | 6/2000 | Brown et al. | 175/93 |
| 6,561,289 | B2 * | 5/2003 | Portman et al. | 175/104 |
| 6,607,043 | B1 * | 8/2003 | Sunde et al. | 175/57 |
| 7,806,203 | B2 * | 10/2010 | Krueger et al. | 175/57 |
| 8,146,679 | B2 * | 4/2012 | Downton | 175/26 |
| 8,322,461 | B2 * | 12/2012 | Hay et al. | 175/45 |
| 2002/0148645 | A1 * | 10/2002 | Falgout, Sr. | 175/40 |
| 2005/0188688 | A1 | 9/2005 | Best et al. | |
| 2006/0243493 | A1 * | 11/2006 | El-Rayes et al. | 175/107 |
| 2008/0164062 | A1 * | 7/2008 | Brackin et al. | 175/24 |
| 2009/0321141 | A1 * | 12/2009 | Kotsonis et al. | 175/67 |

(Continued)

FOREIGN PATENT DOCUMENTS

GB 1145531 3/1969

OTHER PUBLICATIONS

International Search Report for International Application No. PCT/US2013/024796; date of mailing Apr. 15, 2013; 7 pages.

*Primary Examiner* — Kenneth L Thompson
(74) *Attorney, Agent, or Firm* — Christie, Parker & Hale, LLP.

(57) ABSTRACT

A down hole drilling tool for preventing overpressure strain on surface pumping equipment or a down hole drilling motor having a housing and a circulation port and four hydraulic valves positioned on the housing actively working together to effectively open the circulation port to drilling annulus at a high pressure setting and dose the circulation port to annulus at a low pressure setting, the four hydraulic valves include a high pressure setting valve, a low pressure setting valve, a control valve and a fixed setting valve.

18 Claims, 3 Drawing Sheets

(56) References Cited

U.S. PATENT DOCUMENTS

2010/0243259 A1 9/2010 Wright et al.
2010/0314174 A1* 12/2010 Denoix et al. ..... 175/57
2011/0048806 A1* 3/2011 Fincher et al. ..... 175/57
2013/0025940 A1* 1/2013 Grimmer ..... 175/48

* cited by examiner

30

MOTOR SAVER SUB FOR DOWN HOLE DRILLING ASSEMBLIES

CROSS-REFERENCE TO RELATED APPLICATION(S)

This Application claims priority to U.S. Provisional Application No. 61/595,561 filed Feb. 6, 2012 and is incorporated herein in its entirety by this reference.

FIELD OF THE INVENTION

This invention relates to down hole drilling assemblies, and more particularly, to a down hole tool to prevent overpressure scenarios for down hole drilling motors or surface pumping equipment to achieve higher rate of penetration while still maintaining drilling motor pressures within the motor or surface equipment specifications.

BACKGROUND

Coiled tubing drilling requires the use of a down hole positive displacement motor (PDM) to rotate the drill bit. During drilling operations, the unloaded PDM rotates at a constant RPM and achieves a free spin motor pressure with respect to the fluid flow rate. As the drill bit encounters the bottom of the hole and forces are transferred to the bit, referred to as (WOB), the motor will register an increase in torque. This increase in torque is a result of increased resistance to rotating at the constant RPM assuming a constant flow rate of drilling fluid. In return, the PDM requires additional pressure to turn the motor at the constant RPM while under increased resistance. If the resistance increases to a condition which prohibits the PDM from rotating, a motor stall is encountered. During a motor stall, the motor stops turning, the down hole fluid path is severely restricted, and the surface pump pressure dramatically increases. This event can eventually cause a motor failure, which requires the drilling process to be stopped.

Time constraints and the resultant daily operational costs are always a consideration for any down hole drilling operation. High drilling rates of penetration (ROP) coupled with minimal delays results in a highly desirable, cost-effective operation. Overly optimistic drilling rates of penetration in difficult formations place undue strain on sensitive down hole motors and can lead to premature failure of the rubber stator. These failures are expensive and time consuming as they require additional trips to surface as well as motor replacement.

A tool specifically designed to prevent over pressure scenarios for down hole drilling motors having a rotor and a stator arrangement would allow operators to achieve higher rates of penetration while still maintaining drilling motor differential pressures within manufacturer specification. Such an improvement would have tangible results in the pursuit of a highly efficient and cost-effective operation. In order for a down hole tool to protect a drilling motor from over pressure scenarios it must also be able to maintain differential pressures within manufacturer specification, regardless of operator input parameters controlling the rate of penetration. Consequently, a need exists for a down hole tool which can protect the drilling motor from over pressure scenarios while simultaneously allowing the motor to operate within manufacturer specifications. The present invention provides a down hole tool to achieve this objective.

SUMMARY OF THE INVENTION

The present invention comprises a down hole tool, also referred to herein as a motor saver sub, for use in a down hole drilling assembly near the bottom of the tubing near a positive displacement motor and the drill bit. In one embodiment, the tubing comprises a reel of coiled tubing, although the invention can also be used in rotary drilling applications. The motor saver sub operates in two distinct modes, namely normal operation and overpressure prevention. These two modes are controlled by four hydraulic valves acting together to effectively open a circulation port to drilling annulus at a high pressure setting and close the circulation to annulus at a low pressure setting. During the overpressure prevention mode, the circulation rate of the drilling fluid does not have to be reduced or cease in order for the system to reset back to normal operation which is closed to annulus when the overpressure condition expires. The motor saver sub has been designed to allow the operator to maintain the optimum drilling and hole cleaning pump rate while the tool resets itself, a feature not found in other down hole pressure limiting devices. Another feature of the present invention is that during the overpressure prevention mode, not all drilling fluid is diverted to annulus. A certain percentage of the centerline fluid, based upon the pressure requirement of the motor, will continue to pass through the bit and out to annulus. The act of opening the fluid flow path to annulus during the overpressure prevention mode allows the motor saver sub to control the motor differential, or delta, pressures and maintain them within drilling motor manufacturer specifications, thus preventing premature damage to any components of the motor.

The motor saver sub includes four hydraulic valves which include two field adjustable valves, one fixed setting valve and one control valve. The two adjustable valves control the high and low pressure settings for switching between the two operational modes of the tool. The fixed setting valve is an annular circulation port which controls down hole delta pressure. The control valve processes the pressure signals from the adjustable pressure setting valves and opens or closes the annular circulation port which is the fixed setting valve.

During normal drilling operations, average acceptable motor delta pressure range from 300 psi unloaded to a maximum pressure while drilling of approximately 1500 psi. To ensure that the pressure stays within drilling motor manufacturer guidelines, the low and high pressure adjustable valves should be set within an acceptable delta pressure range, for example 500 psi to 1400 psi respectively. The fixed setting valve for the annular circulation port would have any pressure setting above the low pressure and below the high pressure adjustable valve settings, and for this example could be 700 psi.

A first drilling motor operating range would be motor free spin, a result of pumping fluid while the drill bit is off bottom and rotating freely. A normal free spin motor delta pressure would be 300 psi. A second operating range for the motor is during normal drilling operations. The motor rotates the drill bit and as the bit is forced down hole, interaction with open hole formation causes rotational frictional losses reacted on the drill bit face which in turn increases the torque required to turn the motor. The rubber stator in the motor can only handle so much torque and pressure before damage. This normal drilling range is usually 400 psi to 1500 psi. A third operating pressure range during drilling operations is overpressure. When the torque requirement to turn the drill bit as it interacts with the formation increases past normal operating pressures, the rubber stator is subjected to excessive forces from pressure buildup from the rotating rotor. As the work required to turn the drill bit increases, the drilling motor rotor can actually stop rotating, or stall. As this point there is no longer any flow path for the pump fluid to exit to annulus and the pressure builds exponentially. This can cause irreparable damage in a short period of time necessitating a trip to surface to replace.

The motor saver sub of the present invention is designed to operate in conjunction with the drilling motor in these various pressure ranges. During free spin or normal drilling operations of the motor, all drilling fluid passes through the motor saver sub and through the drilling motor. During overpressure operation the annular circulation port through the fixed setting valve is opened to reduce motor pressure. Fluid flow path through the motor is still available. The motor saver sub is able to reset itself without manipulation of the drilling circulation rate by a control valve which operates based upon pilot signals received from the high pressure setting valve and the low pressure setting valves.

These and other aspects of the invention, including additional embodiments, will be more fully understood by reference to the following detailed description and the accompanying drawings.

DETAILED DESCRIPTION

Figure 1:
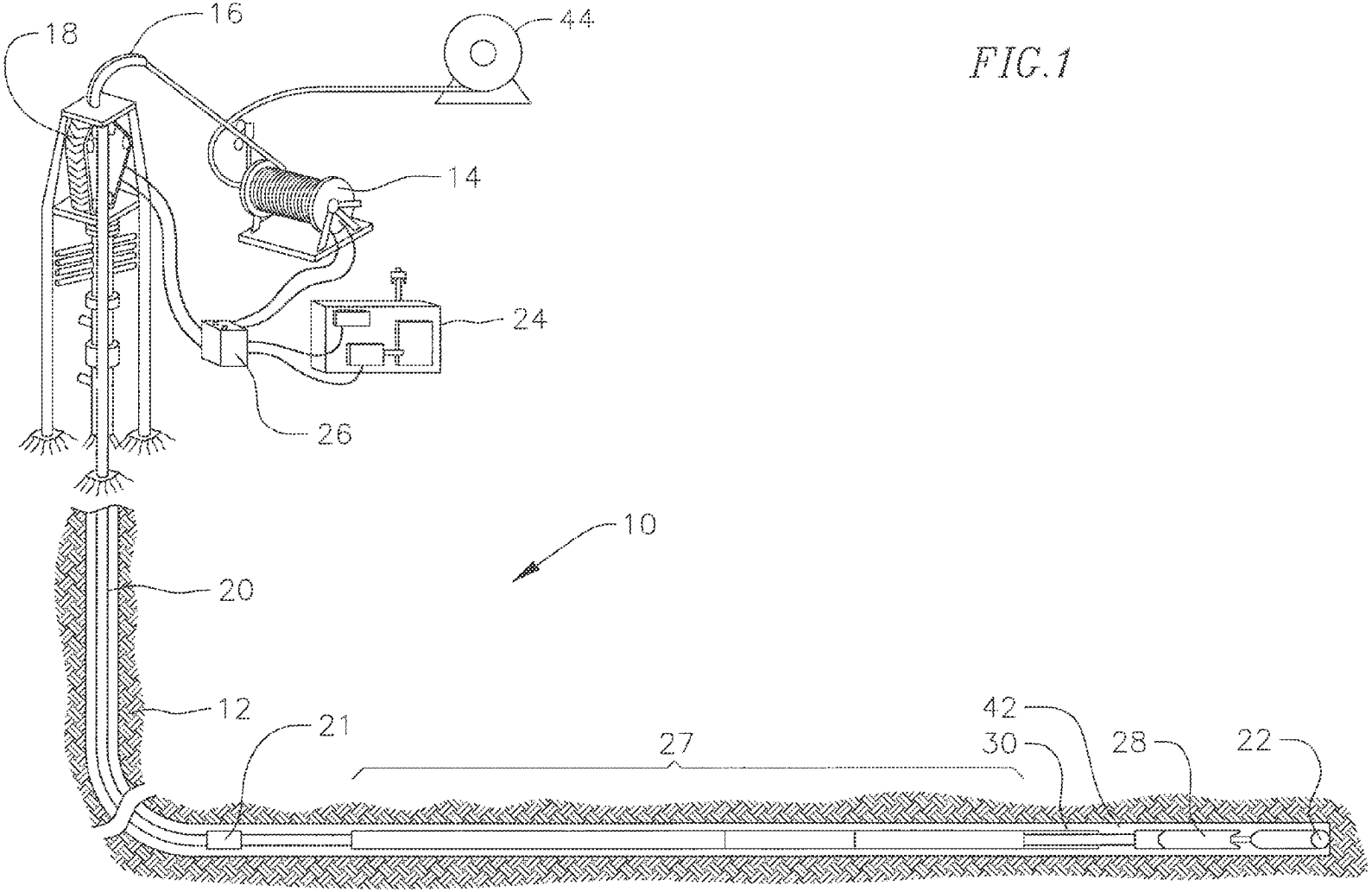
FIG. 1 is a schematic view showing a down hole assembly containing a tool to prevent overpressure conditions for down hole drilling motors according to principles of this invention.

FIG. 1 is a schematic diagram illustrating a coiled tubing drilling system 10 for drilling a well bore in an underground formation 12. The coil tubing drilling system can include a coiled tubing reel 14, a gooseneck tubing guide 16, a tubing injector 18, coiled tubing 20, a coiled tubing connector. 21, and a drill bit 22 at the bottom on the well bore. The drilling system also includes a control cab 24, a power pack 26 and an assortment of other bottom hole assembly tools at 27. This arrangement is all well-known in the art. During drilling, the down hole equipment includes a down hole motor 28, such as a positive displacement motor for rotating the drill bit 22. A down hole tool 30 specifically designed to prevent overpressure scenarios for drilling motor 28 is positioned along the coiled tubing adjacent the motor 28. The tool 30 to prevent overpressure scenarios for the drilling motor and will also be referred to herein as a motor saver sub. The motor saver sub has been designed to prevent overpressure scenarios while allowing drilling system operators to achieve higher rates of penetration while still maintaining drilling motor delta pressures within the motor manufacturer specifications. The motor saver sub protects the drilling motor while enabling the motor to maintain delta pressures regardless of operator input parameters controlling the rate of penetration.

Figure 2:
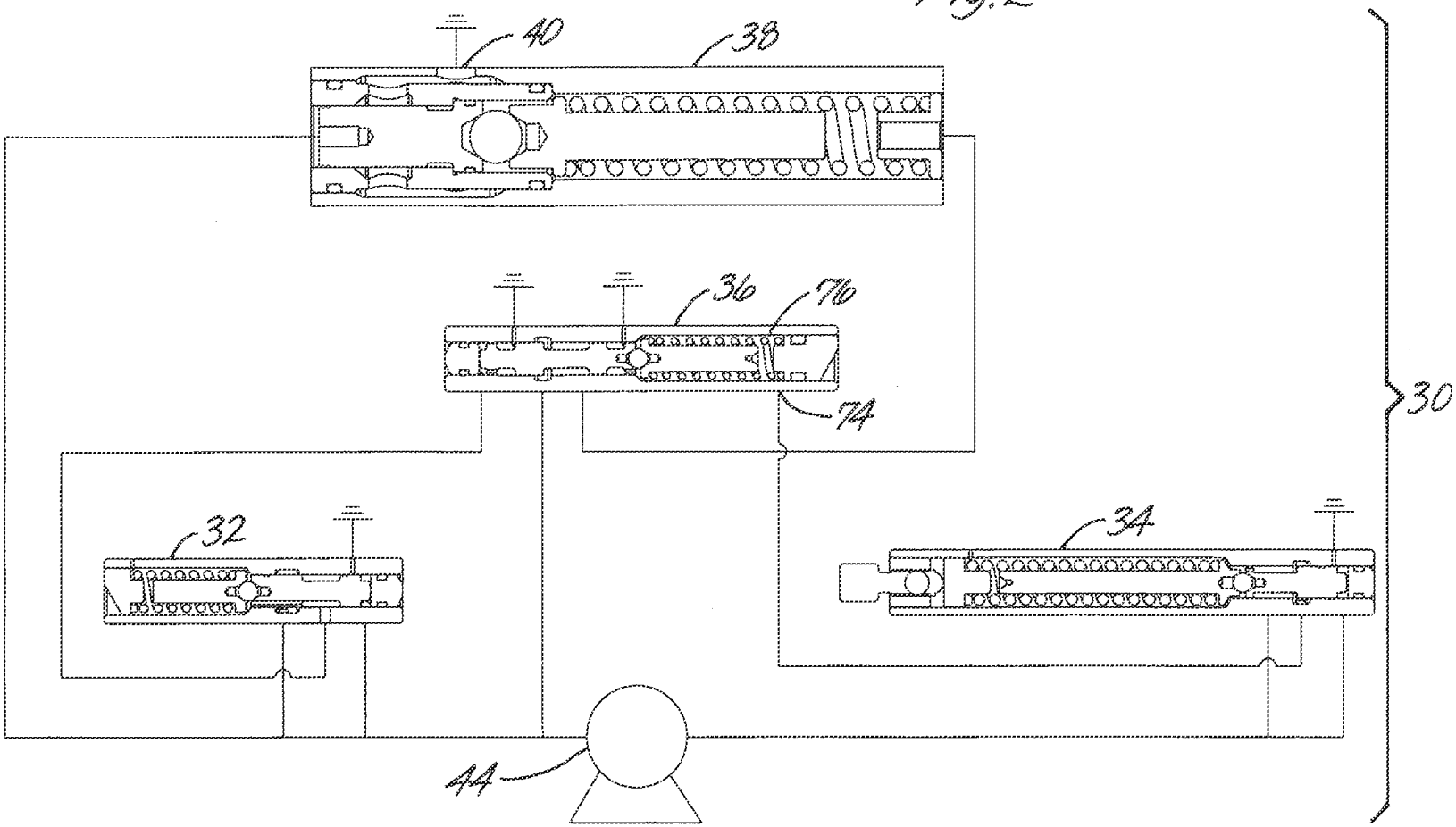
FIG. 2 is a cross-sectional schematic view of the tool of FIG. 1.
Figure 3:
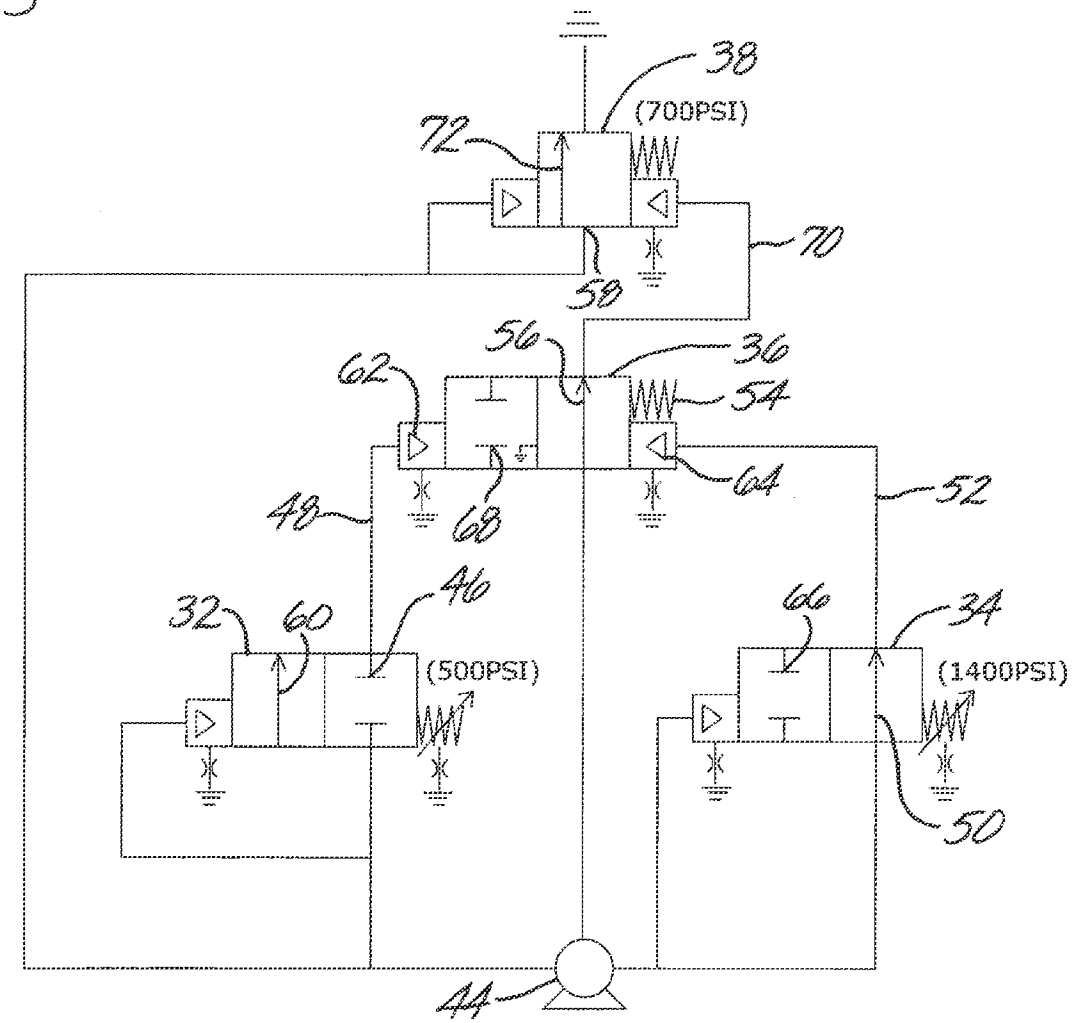
FIG. 3 is a schematic hydraulic diagram of the tool of FIG. 2.

Also referring to FIGS. 2 and 3, the motor saver sub 30 has two modes of operation, namely, normal operation and overpressure prevention operation. These two modes are controlled by four hydraulic valves 32, 34, 36 and 38. These four hydraulic valves act together to effectively open a circulation port 40 to the well bore annulus 42, shown in FIG. 1, at a high pressure setting, and close off the circulation of drilling fluid to annulus at a low pressure setting. During the overpressure prevention mode of operation, the circulation rate of the drilling fluid does not have to reduce or cease in order for the tool to reset back to normal operation (closed to annulus) when the overpressure condition expires. The motor saver sub 30 has been designed to allow the operator to maintain the optimum drilling and hole cleaning pump rate while the tool resets itself. During the overpressure prevention mode, not all drilling fluid is diverted to annulus. A certain percentage of the center line fluid, based upon the pressure requirements of the motor will continue to pass through the drill bit before entering the annulus. The act of opening the fluid flow path Co annulus during overpressure prevention allows the motor saver sub to control the motor delta pressures and maintain them within drilling motor manufacturer specifications thus preventing premature damage to the motor.

The four hydraulic valves of the motor saver sub comprise two field adjustable valves 32, 34, one control valve 36 and one fixed setting valve 38. The two adjustable valves control the high and low pressure settings for switching between the two operational modes of the tool. The fixed setting valve 38 is an annular circulation port which controls down hole delta pressure. The control valve 36 processes pressure signals from the adjustable pressure setting valves 32 and 34 and opens/closes the fixed setting valve annular circulation port 38.

During normal drilling operations, average acceptable motor delta pressure range from 300 psi unloaded to a maximum pressure while drilling of around 1500 psi. To ensure that the pressure stays within drilling motor manufacturer guidelines, the low and high pressure adjustable valves 32 and 34 should be set within the acceptable delta pressure range, for example 500 psi and and 1400 psi respectively. The annular circulation port 38 would have any pressure setting above the low pressure adjustable valve setting, for example 700 psi.

The drilling motor operates within 3 ranges. The first range is motor free spin which results when a pump 44 pumps drilling fluid through the motor while the drill bit 22 is above the bottom of the formation and rotating freely. A normal free spin motor differential pressure would be 300 psi. The second motor operating range occurs during normal drilling operations. The motor rotates the drill bit and as the bit is forced down hole, interaction with the open hole formation causes rotational friction losses reacted on the drill bit face which in turn increases the torque required to turn the motor. Normal drilling range is usually between 400 psi and 1500 psi. The third pressure operating range for the drilling motor is overpressure.

The motor saver sub 30 is designed to operate in conjunction with the drilling motor in the three pressure ranges. In the first range during free spin, the low pressure setting valve 32 is in a closed position 46 and does not provide a pilot signal 48 to the control valve 36. The high pressure setting valve 34 is in a normally open position 50 and sending a pilot signal 52 to the control valve 36. The high pressure valve pilot signal 52 plus the spring force 54 act on the control valve to maintain the control valve in a normally open position 56. The normally open position of the control valve ensures that the annular circulation port stays in a closed position 58. When drilling ahead within the normal operating range of the motor, the low pressure valve 32 will shift to an open position 60 which supplies the pilot signal 48 to the control valve. The high pressure valve will also be supplying the pilot signal 52 to the control valve as normal pressures are below the high pressure valves pressure setting. In this case, the control valve position will remain in its normally open position 56 because the pilot force on 62 on one side of the spool is negated by the pilot force 64 on the other side of the control valve. The only additional force exerted on the spool of the control valve is the spring force 54 which maintains the valve in the normally open position 56.

The final pressure range is overpressure and is any pressure greater than the setting of the high pressure valve 34. In the event of a spike in circulating pressure, usually indicative of a motor stall, the high pressure valve will shift to its closed position 66 and stop sending a pilot signal 52 to the control valve. The control valve will then shift to the close position 68 as the force imbalance of the pilot pressure 62 acting on the low pressure valve side overcomes the spring force 54 on the high pressure valve side. As the control valve ceases to provide a pilot signal 70 to the annular circulation port fixed setting valve 38, the annular circulation port valve will then move to an open position 72 in the same manner as the control valve via a left side/right side force imbalance. The sudden redirection of fluid from the high pressure drilling motor to the low pressure annular circulation port will immediately reduce the down hole differential pressure from 1400 psi to 700 psi and signal the operator that an overpressure scenario has been averted.

Annular circulation port controlled pressure indicates that action needs to be taken. Upon interpretation of the feedback signal provided by the motor saver sub, the operator would then cease running in hole and begin the process of picking the drill string off bottom of the well. The motor saver sub reacts as the down hole differential pressure decreases due to the opening of the annular circulation port fixed setting valve 38. The down hole differential pressure established by the stall/heavily loaded drilling motor and the open annular circulation port fixed valve must not trigger the control valve to shift back to its normally open position. Due to the design of the control valve, the pilot signal 52 from the high pressure valve during the annular circulation port fixed valve controlled pressure is ignored when the control valve is in the closed position 68 which is the overpressure range. This feature is necessary because if the control valve were to shift during the annular circulation port control pressure, the system would reset and result in instability of the annular circulation port opening/closing.

The proper timing for the motor saver sub to reset is when the low pressure valve shifts back to its normally closed position 66 indicative that the motor is unloaded and free spinning. This feature is accomplished by the control valve pilot area 74 on the high pressure valve side being positioned in a larger non-sealing area 76 when in the closed position 68. If no seal around the high pressure valve pilot area is present, the signal has no pressure area to react upon resulting in zero pilot force. In this unique situation, the pilot signal 48 from the low pressure valve controls the position of the control valve and maintains it in the closed position 68 until loss of the low pressure valve pilot signal. As the operator continues to pick the bottom hole assembly off bottom, the annular circulation port maintains 700 psi of pressure on the bottom hole assembly while the drilling motor is still loaded. Once the interaction of the formation on the drill bit ceases, the required port and resultant pressure would decrease back to motor free spin or 300 psi. As the drilling motor begins free spinning, the annular circulation port and low pressure valve would shift back to the normally closed position 58 and 46 respectively. The closing of the low pressure valve would halt the pilot signal 48 to the control valve. The control valve would then move back to its normally open position 56 as a result of a force imbalance on the spool provided by the spring 54 and no opposing pilot forces. This result in drop in pressure from the annular circulation port induced pressure (700 psi) to motor free spin pressure (300 psi) is the second feedback signal to the operator indicating that normal drilling operations can recommence. The motor saver sub is then fully reset and ready for additional motor protection cycles without manipulating drilling and hole cleaning pump rate.

One particular embodiment of the present invention is designed for rotary and coiled tubing drilling operations. A range of sizes from 2⅛" to 10" can be achieved to meet a particular application. A specific motor saver sub can have a 4.75" tool outside diameter, a 2.0" tool inside diameter, is 22" in length and has a flow rate of 0-10 BPM. The materials used in a motor saver sub include various corrosion resistant and erosion resistant materials. Stainless alloys are used in the tool joints and housing of the tool. MP35N or Eligiloy is used for the valve spring. Tungsten carbide is used in the valve spools and bodies. Seals are made from commercially available elastomers that are fit for down hole use.

The motor saver sub of the present invention may be installed in a bottom hole assembly as a single component or it may be used with other components in addition to the down hole motor and drill bits including milling bits, tractors and nozzle and circulation subs as commercially available from BJS Services, Schlumberger, Halliburton, Baker Hughes, and Weatherford. For example, the motor saver sub can be used in conjunction with a down hole tractor to aid in CT drilling operations in connection with a down hole tractor. The tractor can be as described in U.S. Pat. No. 7,343,982 which is used to move down hole equipment in the bore. When an overpressure situation occurs, the motor saver sub would effectively shut off the tractor and allow the operator to pick the bottom hole assembly off the bottom and restart drilling operations.

Features and benefits of the present invention include during free spin or normal drilling operations all drilling fluid passes through the drilling motor. In an overpressure condition, the annular circulation port opens to reduce motor pressure however drilling fluid continues to flow through the motor. The tool resets itself without manipulation of the drilling circulation rate. The control valve is a non-symmetrical pilot area for operation of the control valve and the motor saver sub has been designed with uni-directional engineered leakage to better tolerate drilling fluid and associated debris in hydraulic control systems.

Although the present invention has been described and illustrated with specific embodiments thereof, it is to be understood that the invention is not to be so limited as changes and modifications can be made which are within the full intended scope of the invention as hereinafter claimed.

What is claimed is:

1. A down hole drilling tool for preventing overpressure of surface pumping equipment comprising:

a housing having a circulation port; and four hydraulic valves positioned on the housing actively working together to effectively open the circulation port to annulus at an overpressure condition of the down hole drilling motor and to reset the down hole drilling tool to close the circulation port to annulus at a free spin condition of the down hole drilling motor;

wherein the four hydraulic valves include a low pressure setting valve, a high pressure setting valve, a control valve and a fixed setting valve having the circulation port.

2. The tool of claim 1 wherein the control valve operates the fixed setting valve based upon pressure signals from the low pressure setting valve and the high pressure setting valve.

3. The tool of claim 1 wherein in the free spin operating condition of the down hole drilling motor the low pressure setting valve is closed, the high pressure setting valve is open, the control valve is open and the fixed setting valve is closed.

4. The tool of claim 1 wherein in a normal drilling motor operating range, the fixed setting valve is closed, the low pressure setting valve is open, the high pressure setting valve is open and the control valve is open; and in an above drilling motor operating range, the high pressure setting valve is closed, the control valve is closed and the fixed setting valve is open.

5. The tool of claim 1 wherein the control valve has a pilot area nearest the high pressure setting valve positioned in a larger non-sealing area when in the closed position.

6. The tool of claim 5 wherein the tool operates to open and close the circulation port without adjusting a drilling pump rate.

7. The tool of claim 1 wherein the tool is positioned in a bottom hole assembly of a drill string further comprising a down hole motor and a drill bit.

8. The tool of claim 7 wherein the bottom hole assembly further comprises a tractor.

9. The tool of claim 7 wherein the tool is utilized in a coiled tubing drill string or a rotary drill string.

10. A down hole drilling assembly comprising:

a drill bit;

a drive motor for rotating the drill bit;

a tubing for supplying drilling fluid to the drive motor;

a drilling fluid pump for delivering drilling fluid through the tubing to the drive motor; and a motor saver sub positioned adjacent the drive motor for preventing overpressure strain on the drive motor, wherein the motor saver sub comprises a housing having a circulation port and four hydraulic valves positioned on the housing actively working together to open the circulation port to annulus at an overpressure condition of the drive motor and to reset the motor saver sub to close the circulation port to annulus at a free spin operating condition of the drill bit;

wherein the four hydraulic valves include a low pressure setting valve, a high pressure setting valve, a control valve and a fixed setting valve having the circulation port.

11. The assembly of claim 10 wherein the control valve operates the fixed setting valve based upon pressure signals from the low pressure setting valve and the high pressure setting valve.

12. The assembly of claim 10 wherein in the free spin operating condition of the drill bit the low pressure setting valve is closed, the high pressure setting valve is open, the control valve is open and the fixed setting valve is closed.

13. The assembly of claim 10 wherein in a normal drilling motor operating range, the fixed setting valve is closed, the low pressure setting valve is open, the high pressure setting valve is open and the control valve is open; and in an above drilling motor operating range, the high pressure setting valve is closed, the control valve is closed and the fixed setting valve is open.

14. The assembly of claim 10 wherein the control valve has a pilot area nearest the high pressure setting valve positioned in a larger non-sealing area of the motor saver sub.

15. The assembly of claim 10 wherein the motor saver sub operates without adjusting a drilling pump rate.

16. The assembly of claim 10 further comprising a tractor.

17. The assembly of claim 10 wherein the four hydraulic valves are hydraulic spring valves.

18. The assembly of claim 10 wherein the tubing is coiled tubing.

* * * * *